US005732508A

United States Patent [19]

Latta et al.

[11] Patent Number: 5,732,508

[45] Date of Patent: Mar. 31, 1998

[54] GATE CLOSER

[76] Inventors: Robert W. Latta, 6062 Dudman Ave., Garden Grove, Calif. 92645; David D. Mowery, 6363 Sherman Way, Buena Park, Calif. 90620

[21] Appl. No.: 516,498

[22] Filed: Aug. 17, 1995

[51] Int. Cl.[6] ..... E05F 1/10

[52] U.S. Cl. ..... 49/386; 49/381

[58] Field of Search ..... 49/386, 381; 16/71, 16/51

[56] References Cited

U.S. PATENT DOCUMENTS

| | | | |
|---|---|---|---|
| 155,129 | 9/1874 | Warren . | |
| 176,539 | 4/1876 | Klein . | |
| 1,827,365 | 10/1931 | Keene . | |
| 1,989,908 | 2/1935 | Bohnsack et al. . | |
| 2,550,756 | 5/1951 | Bartoszek . | |
| 2,866,224 | 12/1958 | Ellis . | |
| 3,373,529 | 3/1968 | Ingham | 16/71 |
| 4,434,524 | 3/1984 | Gilchrist | 48/386 |
| 4,831,687 | 5/1989 | Lin et al. | 16/71 |
| 5,193,647 | 3/1993 | O'Brien | 48/386 |

FOREIGN PATENT DOCUMENTS

| | | | |
|---|---|---|---|
| 3313220 | 10/1984 | Germany | 16/51 |
| 2124695 | 2/1984 | United Kingdom | 16/71 |

*Primary Examiner*—Blair Johnson
*Assistant Examiner*—Curtis Cohen
*Attorney, Agent, or Firm*—Knobbe, Martens, Olson & Bear, LLP

[57] ABSTRACT

A gate closer for a gate is provided. The gate closer includes a first housing which is mounted to a supporting structure of the gate. A hydraulic gate closer is installed within the first housing. A second housing is attached to the gate and an adjustable arm is installed within this second housing. The first and second housings are installed such that a rotatable shaft of the hydraulic gate closer engages the adjustable arm so that the gate closer can safely and securely close the gate.

9 Claims, 2 Drawing Sheets

GATE CLOSER

BACKGROUND OF THE INVENTION

1. Field of the Invention

The present invention relates in general to a door closer and, in particular, to an improved gate closer.

2. Description of Relevant Art

Many types of devices have been used to close an outdoor door or gate. For example, many typical outdoor gates have an elongated spring which has one end connected to the gate and the other end connected to a fixed surface so that the spring can pull the gate closed. Thus, while the gate is being opened, the spring is stretched and energy is stored in the spring. When the force on the gate is released, the spring pulls the gate back towards its original position. Disadvantageously, the elongated spring frequently requires a significant amount of force to open the gate, and the spring only pulls the gate closed in one direction. In addition, the spring often causes the gate to slam shut which helps ensure that the gate is completely closed. The slamming gate, however, frequently hits the person walking through the entrance.

On the other hand, the elongated spring type gate closer often slowly and only partially closes the gate because the spring does not have sufficient force to securely pull the gate into a closed position. Thus, the gate often remains in a partially open position. This is highly disadvantageous in many situations such as security gates or gates that are used to enclose hazards such as swimming pools. For example, a swimming pool gate that does not securely close creates a dangerous situation where small children may enter and be seriously injured or drown if they fall into the pool. In fact, many states and cities have laws or regulations that require swimming pools be enclosed by a fence or wall, and that any entrances must be self-closing.

Other types of gate closers are also known. These gate closers generally have a spring in combination with one or more extending arms. These exposed extending arms and springs often create a safety hazard because they protrude outwardly from the gate and objects such as a person's fingers may be caught in the moving parts. Additionally, these types of gate closers are frequently only effective in closing the gate in one direction and cannot be used to close the gate in both directions. Further, in a manner similar to that described above, these types of gate closers also frequently either slam the gate closed or they are unable to securely close the gate.

Prior gate closers that use a coiled or volute spring are also known. For example, U.S. Pat. No. 155,129 issued to Warren discloses a self-closing gate having a spring coiled about a sleeve so that the gate may be opened in either direction. After the gate is opened and the force on the gate is removed, the spring returns the gate to its closed position. In addition, U.S. Pat. No. 176,539 issued to Klein discloses a spring hinge for gates in which the gate may be opened in either direction. The Klein patent discloses a volute spring which is mounted on the pivot axis of the gate. The double acting spring allows the door or gate to be opened in either direction and the spring returns the gate to its closed position.

These prior gate closers utilizing a volute spring, however, are disadvantageous because a large amount of force is frequently required to open the gate and then the gate slams shut to ensure closing of the gate. Alternatively, volute springs that requires less force to open the gate may be utilized, but this often results in a gate that does not completely close.

There is a need for a gate closer that does not have the above-described disadvantages.

Door closers that are used inside buildings are also known. These indoor door closers are often located in the ceiling or frame above the door. Because the door closer is typically hidden from view, this type of door closer is frequently called a concealed overhead door closer. In fact, it is now common in many new buildings for the concealed overhead door closer to be mounted in the door frame before the combination door frame and concealed door closer is installed in the building.

Concealed overhead door closers are advantageous because they are hidden from view and have no exposed components which protrude from the door or frame. As known to one of ordinary skill in the art, a concealed overhead door closer typically contains a hydraulic mechanism which allows the door to be opened with a relatively small force. The hydraulically controlled overhead door closer then slowly and securely closes the door once the force is removed. Thus, the concealed overhead door closer is advantageous because it securely closes the door without slamming the door shut.

In further detail, the concealed overhead door closer is mounted in the door frame or ceiling such that a rotatable shaft is aligned with the pivot axis of the door. The rotatable shaft is then connected to the door. As is well known in the art, an arm or other connecting member maybe used to connect the shaft to the door. The opening of the door causes the shaft to rotate and the overhead concealed door closer generally provides some resistance to the opening of the door. Once the force on the door is removed, the concealed overhead door closer rotates the shaft back to its original position. This causes the door to return to its original position.

A known concealed overhead door closer is made by International Door Closer of California. In a manner similar to that described above, the International concealed overhead door closer hydraulically closes the door in a smooth and controlled manner. Significantly, the International concealed overhead door closer does not slam the door and the door is securely closed.

In addition, door closers which are mounted in the floor beneath the door are also known. These door closers are generally similar to the concealed overhead door closers in that the door is slowly and securely closed, but they have the significant disadvantage of requiring a portion of the floor be removed for installation. This may be particularly difficult if the floor is concrete. As is well known to one of ordinary skill in the art, these prior in-ground door closers are typically mounted in a specially designed pan and then set in concrete. It will be appreciated that this in-ground location causes many problems, including installation, service and replacement of the closer.

It is desirable to construct a gate closer which does not have the above-described significant disadvantages of the prior gate closers.

SUMMARY OF THE INVENTION

In accordance with one aspect of the present invention, the above-described disadvantages of prior gate closers are overcome by a housing which encloses a concealed overhead door closer so that the concealed overhead door closer can be utilized to close a gate. As set forth above, prior concealed overhead door closers could only be used inside buildings with doors having an overhead support because the closer had to be mounted in the door frame or ceiling above the door. Specifically, the closer could not be used with a gate having no overhead frame or similar support structure in which to mount an overhead concealed door closer.

The present invention includes a mounting bracket which allows a concealed overhead door closer to be used with a gate. The concealed overhead door closer advantageously allows a gate to be slowly and securely closed. Significantly, the present invention does not require a support member that extends across the opening to the gate. Further, the present invention can advantageously be mounted to the upper or lower surface of the gate.

In accordance with another embodiment of the invention, a first housing for a hydraulic gate closer is used in combination with a second housing for an adjustable arm. The first housing, which encloses the hydraulic gate closer is mounted to a support or post supporting the gate. The hydraulic gate closer has a rotatable shaft which extends through an opening or cut-out in the first housing. The second housing, which encloses the arm, is mounted to the gate. The second housing has a cut-out at one end which exposes an end of the adjustable arm. This end of the arm is configured to receive and hold the end of the rotatable shaft. The first and second housings are aligned such that the rotatable shaft is generally aligned with the pivot axis of the door and the shaft is held within the exposed end of the adjustable arm. Thus, the opening of the gate causes the arm to move and the shaft of the hydraulic door closer to rotate. When the force on the door is removed, the closer rotates the shaft back to its original position and this causes the door to close.

BRIEF DESCRIPTION OF THE DRAWINGS

These and other features of the invention will now be described with reference to the drawings of preferred embodiments, which are intended to illustrate and not to limit the invention, in which.

DETAILED DESCRIPTION OF THE PREFERRED EMBODIMENTS

Figure 1:
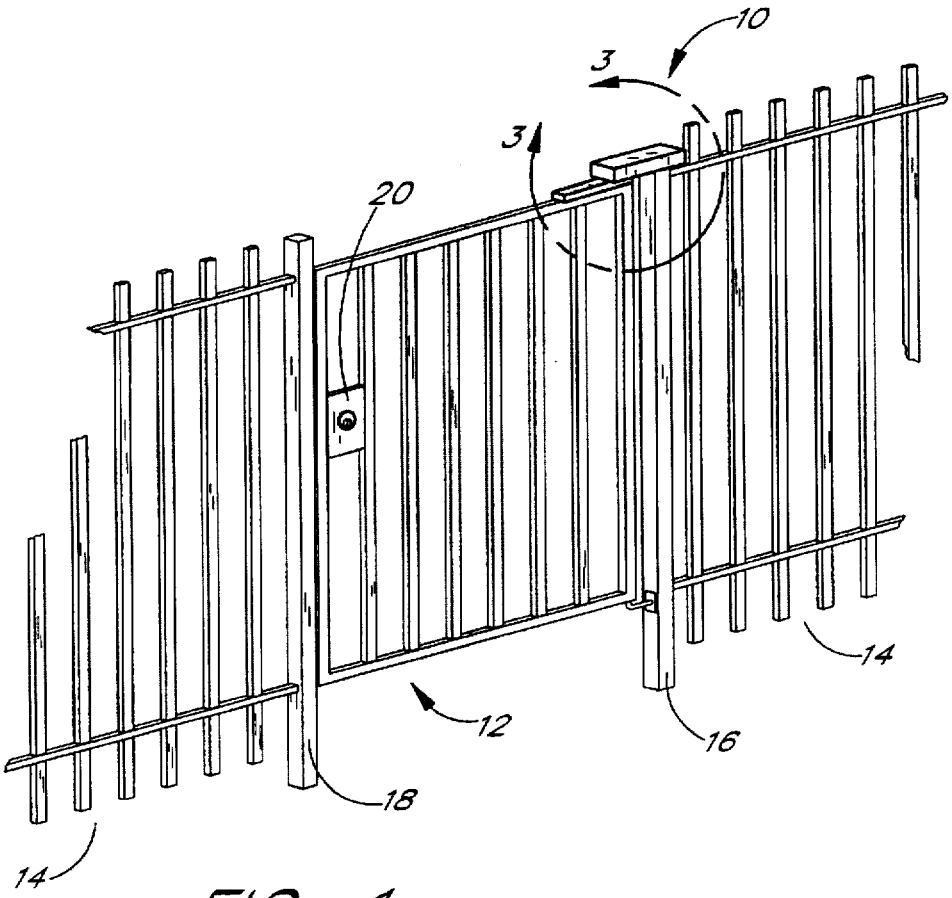
FIG. 1 is a perspective side view of a gate closer in accordance with the preferred embodiment of the present invention attached to a closed gate.

As shown in FIG. 1, a gate closer 10 is configured in accordance with a preferred embodiment of the present invention. The gate closer 10 is preferably used to close a gate 12 in a fence 14. It will be understood that gate is intended to be used broadly and to include doors and similar structures that control access to an entrance or opening. In addition, this application is intended to include any gate that does not have an overhead supporting member or frame, whether located inside or outside a building.

As illustrated in FIG. 1, the gate 12 is located between posts 16 and 18. As is well known, the gate 12 is preferably pivotably attached to the post 16 and has a latching or locking member 20 which engages the post 18 so that the gate 12 can be held in a closed position. One of ordinary skill in the art will readily recognize that a gate can be used in a variety of applications and supported by many different types of structures.

Figure 2:
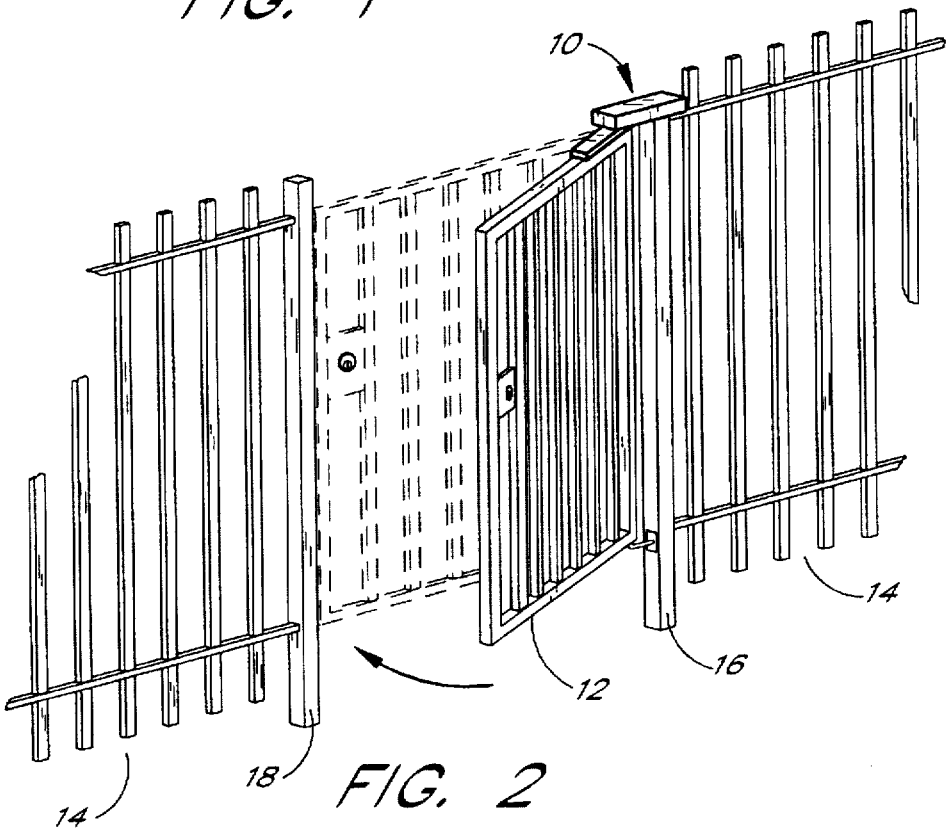
FIG. 2 is a perspective side view of the gate closer of FIG. 1 attached to an open gate.

As shown in FIG. 1, the gate closer 10 is shown in the closed position. As shown in FIG. 2, the gate closer 10 is shown in the open position. In the open position, the gate 12 allows ingress and egress through the opening. Although not illustrated in the accompanying figures, the gate closer 10 preferably allows the gate 12 to swing open in either direction.

Figure 3:
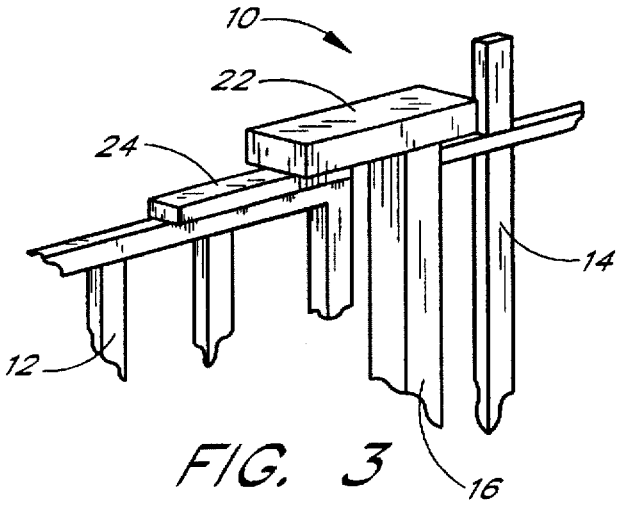
FIG. 3 is an enlarged, partial perspective side view of the gate closer of FIG. 1.

As best seen in FIG. 3, the gate closer 10 includes a first housing 22. The first housing 22 is preferably securely attached to the fence 14, for example, by means such as welding, bolting, gluing and the like. More preferably, the first housing 22 is attached to the post 16 such that the housing 22 is held in a stationary position. A second housing 24 is securely attached to the gate 12, for example, by means such as welding, bolting, gluing and the like. Thus, the opening and closing of the gate 12 causes corresponding movement of the second housing 24.

Figure 4:
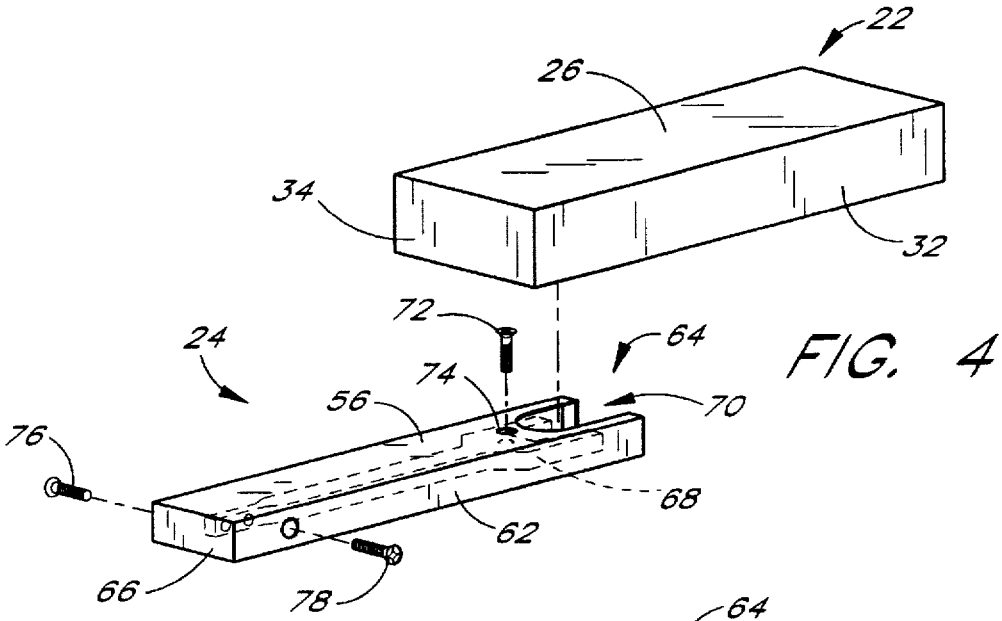
FIG. 4 is an exploded perspective side view of a gate closer in accordance with the preferred embodiment of the present invention.
Figure 5:
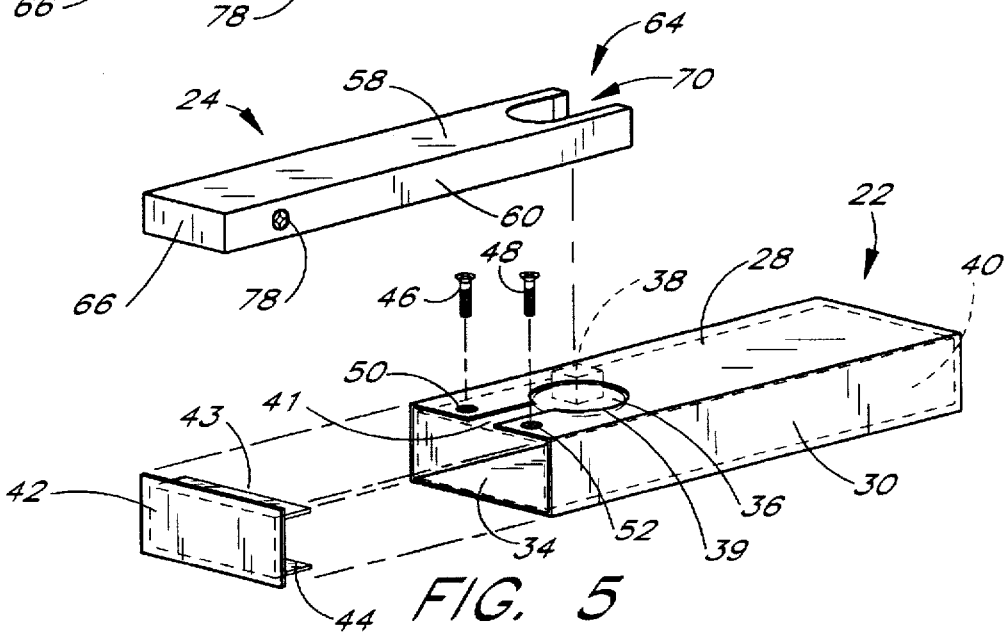
FIG. 5 is an exploded perspective side view of a gate closer in accordance with another preferred embodiment of he present invention.

As best seen in FIGS. 4 and 5, the first housing 22 is preferably generally rectangular in shape having a top surface 26, bottom surface 28, left side 30, right side 32, front end 34 and back end (not shown). The housing 22 preferably has a length of about 11¾ inches, a width of about 4 inches and a height of about 2 inches. Preferably this configuration allows a concealed overhead door closer of the type manufactured by International to be inserted into the housing 22. It will be understood, however, that the housing 22 can be formed in a variety of shapes according to, for example, the size and shape of gate to be closed. One of ordinary skill in the art will also recognize that the housing 22 may be configured to enclose door closers of different shapes, sizes, models or constructed by different manufacturers.

As shown in FIG. 5, the bottom surface 28 of the first housing 22 preferably has a key-shaped aperture or cut-out 36 configured to allow a rotatable shaft 38 of a concealed overhead door closer 40 (both shown in phantom) to extend through the cut-out 36. The cut-out 36 is preferably located along a longitudinal axis of the housing 22 and includes a generally circular section 39 having a diameter of about 1 ⅞ inches. The center of the circular section 39 is preferably located about 2¾ inches from the front end 34 of the housing 22. A passageway 41, which is about ¾ of an inch wide and extends along the longitudinal axis, extends from the circular section 39 to the front end 34 of the housing 22. The passageway 41 allows the concealed overhead door closer 40 to be inserted into the housing 22 and the rotatable shaft 38 to be positioned within the circular section 39.

The front end 34 of the housing 22 preferably includes a removable cap 42 having a pair of inwardly extending flanges 43 and 44. The flanges 43 and 44 are preferably spaced such that they engage or are located proximate the inner sides of the top surface 26 and bottom surface 28 of the housing 22. A pair of threaded members 46 and 48 preferably extend through threaded openings 50 and 52, respectively, in the bottom surface 28 of the housing 22 to engage and hold the removable cap 42 proximate the front end 34 of the housing 22. It will be understood that the cap 42 may be attached to the front end 34 by any known means including bolts, friction-fit and the like; or the cap 40 may be permanently attached to the front end 34 of the housing 20 after the concealed overhead door closer 40 is installed.

Securely fastened to the upper surface of the gate 12 is a second housing 24 which has a top surface 56, bottom surface 58, left side 60, right side 62, front end 64 and back end 66. The housing 24 is preferably about 9¾ inches in length, about 1 inch in height and about 2 inches in width. The housing 54 is preferably configured to allow an adjustable arm 68 (shown in phantom) to be installed. More preferably, a "K"-style adjustable arm manufactured by international is installed. It will be understood, however, that the housing 24 can be formed in a variety of shapes and sizes according to factors such as the type of gate or arm.

As seen in FIGS. 4 and 5, an arc or concave shaped opening 70 is located at the front end 64 of the housing 24. The opening 70 preferably inwardly extends about 1½ inches so that one end of the adjustable arm 68 is exposed. This end of the arm 68 preferably contains an opening or aperture configured to receive and hold a rotatable shaft 38 of a concealed overhead door closer 40. A threaded member 72 is preferably inserted through a threaded opening 74 in the top surface 56 of the housing 24 to securely hold the arm 68 within the housing 24.

Further, threaded members 76 and 78 are preferably installed in the left and right sides 60 and 62, respectively, of the housing 24. The threaded members 76 and 78 are located proximate the back end 66 of the housing 24 and are configured to engage the end of the adjustable arm 68. It will be understood that the arm 68 can be held generally along a longitudinal axis of the housing 24 by inserting the threaded members 76 and 78 a substantially equivalent distance into the housing 24. The position of the arm 68 within the housing 24 can also be adjusted by inserting a threaded member on one side of the arm further into the housing 24 and removing the threaded member on the other side a substantially equivalent distance. For example, if the arm 68 was originally centrally located within the housing 24, the threaded member 78 on the right side may be inserted an additional ½ inch into the housing 24 and the threaded member 76 on the left side may be removed ½ inch. Thus, the arm 68 is moved about ½ inch toward the left side of the housing 24. This allows the closed position of the gate 12 to be adjusted.

The gate closer 10 is preferably installed by securely attaching the first housing 22 to the post 16 such that the rotatable shaft 38 of the concealed overhead door closer 40 is generally aligned with the pivot axis of the gate 12. The second housing 24 is preferably fixed to the gate 12 such that the end of the arm 68 located within the opening 64 is aligned with the rotatable shaft 38. The shaft 38 is then inserted into an opening or aperture of the arm such that the movement of the arm 68 causes the shaft 38 to rotate.

In operation, the housing 24 and adjustable arm 68 move according to the movement of the gate 12. Because the shaft 38 of the concealed overhead door closer 40 is held within an opening at one end of the arm 68, the movement of the gate 12 also causes the shaft 38 to rotate. When the force opening the gate is removed, the concealed overhead door closer 40 rotates the shaft 38 back to its original position and this causes the gate 12 to close. Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A mounting, bracket and protector, comprising:

a gate;

a gate closer, said gate closer having a rotatable shaft;

a first housing configured to hold said gate closer, said first housing having a top surface, a bottom surface, a first side, a second side, a first end and a second end; and a second housing configured to hold an adjustable arm, said second housing mounted on said gate, said second housing having a top surface, a bottom surface, a first side, a second side, a first end and a second end;

an adjustable arm, said adjustable arm being mounted within said second housing, said adjustable arm having a longitudinal axis and said second housing having a longitudinal axis, wherein said longitudinal axis of said adjustable arm is adjustable along said longitudinal axis of said second housing.

wherein said gate closer is mounted inside said first housing and said rotatable shaft engages said gate to allow said gate to be closed by said gate closer.

2. A mounting bracket and protector as in claim 1, wherein said second housing includes a cut-out proximate said first end, said cut-out exposing an end of said adjustable arm.

3. A mounting bracket and protector as in claim 2, wherein said rotatable shaft of said gate closer is held within an opening in said end of said adjustable arm such that, by virtue of the connection, a force opening the gate causes the shaft to rotate from an original position and when the force is removed, the gate closer rotates the shaft back to the original position which causes the gate to close.

4. A mounting bracket and protector for a gate closing device, comprising:

a gate closer, said gate closer having a rotatable shaft:

a first housing configured to hold said gate closer, said first housing having a top surface, a bottom surface, a first side, a second side, a first end and a second end:

an end cap mounted to said first end of said first housing:

a second housing configured to hold an adjustable arm, said second housing configured to be mounted on a gate, said second housing having a top surface, a bottom surface, a first side, a second side, a first end and a second end; and an adjustable arm, said adjustable arm being mounted within said second housing, said adjustable arm having a longitudinal axis and said second housing having a longitudinal axis;

wherein said gate closer is mounted inside said first housing and said rotatable shaft engages said gate to allow said gate to be closed by said gate closer, wherein said longitudinal axis of said adjustable arm is adjustable along said longitudinal axis of said second housing, and wherein said second housing has an opening in said first side and said second side to allow threaded members to be rotatably inserted, said threaded members engaging said adjustable arm to control the location of the arm within said second housing.

5. A mounting bracket and protector as in claim 4, wherein said rotatable shaft of said gate closer is held within an opening in said end of said adjustable arm such that, by virtue of the connection, a force opening the gate causes the shaft to rotate from an original position and when the force is removed, the gate closer rotates the shaft back to the original position which causes the gate to close.

6. A method of installing a gate closer to a gate, comprising:

mounting a first housing to a supporting member of said gate;

inserting a gate closer into said first housing;

mounting a second housing to said gate;

inserting an adjustable arm into said second housing;

engaging said gate closer and said adjustable arm; and inserting threaded members into apertures located in said second housing to control the location of said adjustable arm within said second housing.

7. A mounting bracket and protector for a closer device, comprising:

a first housing configured to hold the closer device, the closer device having a rotatable shaft;

an adjustable arm, said adjustable arm having a longitudinal axis;

a second housing, said second housing having a longitudinal axis, said second housing configured to hold said adjustable arm;

wherein said first housing and said second housing are aligned to allow the rotatable shaft and the adjustable arm to engage, wherein said longitudinal axis of said adjustable arm is adjustable along said longitudinal axis of said second housing, and wherein said second housing includes a top surface, a bottom surface, a first side, a second side, a first end, and a second end, wherein said second housing has an opening in said first side and said second side to allow threaded members to be rotatably inserted, said threaded members engaging said adjustable arm to control the location of said adjustable arm within said second housing.

8. A mounting bracket and protector for a closer device, comprising:

a first housing configured to hold the closer device, the closer device having a rotatable shaft, said first housing having a top surface, a bottom surface, a first side, a second side, a first end, and a second end;

a second housing configured to hold an adjustable arm, said second housing having a longitudinal axis;

an adjustable arm having a longitudinal axis, said adjustable arm mounted within said second housing;

wherein said first housing and said second housing are aligned to allow the rotatable shaft and the adjustable arm to engage, wherein said first housing is adapted to be mounted to a support member so that said top surface is open, wherein said longitudinal axis of said adjustable arm is adjustable relative to said longitudinal axis of said second housing, and wherein said second housing includes a top surface, a bottom surface, a first side, a second side, a first end, a second end, and wherein said second housing has an opening in said first side and said second side to allow threaded members to be rotatably inserted, said threaded members engaging said adjustable arm to control the location of the arm within said second housing.

9. A mounting bracket and protector as in claim 1, further comprising a key-shaped cut-out proximate the first end of said first housing configured to allow said rotatable shaft from said gate closer to extend through said cut-out.

* * * * *